United States Patent [19]

Hamburg

[11] Patent Number: 5,067,469

[45] Date of Patent: Nov. 26, 1991

[54] FUEL VAPOR RECOVERY SYSTEM AND METHOD

[75] Inventor: Douglas R. Hamburg, Birmingham, Mich.

[73] Assignee: Ford Motor Company, Dearborn, Mich.

[21] Appl. No.: 725,931

[22] Filed: Jun. 27, 1991

Related U.S. Application Data

[63] Continuation of Ser. No. 405,153, Sep. 11, 1989, abandoned.

[51] Int. Cl.[5] ..... F02M 33/02

[52] U.S. Cl. ..... 123/520; 123/458

[58] Field of Search ..... 123/516, 518, 519, 520, 123/521, 458, 506

[56] References Cited

U.S. PATENT DOCUMENTS

| | | | |
|---|---|---|---|
| 4,446,838 | 5/1984 | Suzuki | 123/519 |
| 4,641,623 | 2/1987 | Hamburg . | |
| 4,665,878 | 5/1987 | Takeuchi et al. . | |
| 4,705,007 | 10/1987 | Plapp | 123/519 |
| 4,715,340 | 12/1987 | Cook et al. . | |
| 4,763,634 | 8/1988 | Morozumi . | |
| 4,788,960 | 12/1988 | Oshizawa | 123/458 |
| 4,809,667 | 3/1989 | Vranishi | 123/518 |
| 4,817,576 | 4/1989 | Abe | 123/518 |
| 4,865,000 | 9/1989 | Yajima | 123/520 |

FOREIGN PATENT DOCUMENTS

| | | | |
|---|---|---|---|
| 0205451 | 8/1988 | Japan | 123/519 |
| 0069747 | 3/1989 | Japan | 123/519 |
| 0244134 | 9/1989 | Japan | 123/519 |

*Primary Examiner*—Carl Stuart Miller

*Attorney, Agent, or Firm*—Allan J. Lippa; Peter Abolins

[57] ABSTRACT

An internal combustion engine includes an air/fuel ratio control system for providing a desired fuel charge to the engine in relation to a measurement of inducted airflow. The mixture of inducted air and fuel is trimmed in response to an exhaust gas oxygen sensor for maintaining a desired air/fuel ratio. A fuel vapor recovery system is also included for inducting fuel vapors from the fuel system into the engine in proportion to inducted airflow. The desired fuel charge is corrected by a factor approximating response time of a change in vapor flow rate caused by a change in inducted airflow.

12 Claims, 2 Drawing Sheets

12
26
22
38
MAF
43
MAP
T
48
RPM
50
40
30
34
36
32
44
42
74
pw1
72
70
TRANSFER FUNCTION MULTIPLIER
RPM
90
94
88
pw2
86
84
82
80
T
RPM
16
Fd
58
LAMBSE
60
PI CONTROLLER
KAMREF
54
64
MAF
MAP
RPM
A/FRef
RPM
MAP
24
20

FUEL VAPOR RECOVERY SYSTEM AND METHOD

This application is a continuation of application Ser. No. 07/405,153, filed Sept. 11, 1989 now abandoned.

BACKGROUND OF THE INVENTION

The field of the invention relates to fuel vapor recovery systems wherein fuel vapors from the fuel system are inducted into an internal combustion engine. In particular, the invention relates to control of fuel vapor recovery in engines equipped with air/fuel ratio feedback control.

Air/fuel ratio feedback control is commonly used on modern motor vehicles to maintain air/fuel ratio near a desired air/fuel ratio such that efficiency of a catalytic converter is optimized. For example, when three-way catalytic converters ($NO_x$, CO, and HC) are utilized, the inducted air/fuel ratio is maintained at a value which is within the catalytic converter's operating window. This value is commonly referred to as stoichiometry (14.7 lbs.air/1 lb.fuel).

Examples of known air/fuel ratio feedback control systems are disclosed in U.S. Pat. No. 4,641,623 issued to Hamburg and U.S. Pat. No. 4,763,634 issued to Morozumi wherein a desired fuel charge is calculated by dividing a measurement of inducted airflow with the desired air/fuel ratio. This desired fuel charge is then trimmed by a feedback correction value obtained from an exhaust gas oxygen sensor to maintain the desired air/fuel ratio.

Air/fuel ratio control is complicated by vehicles having vapor recovery systems. A typical vapor recovery system includes a vapor storage canister (usually containing activated charcoal) coupled to the fuel tank for adsorbing hydrocarbons which would otherwise be vented to the atmosphere. Since the canister has a finite storage capacity, it is necessary to periodically purge hydrocarbons from the canister. This is accomplished by a purge line connected between the canister and engine air/fuel intake. Under certain engine operating conditions, ambient air is purged through the canister and inducted into the air/fuel intake. In many fuel vapor recovery systems, vapors are also inducted directly from the fuel tank during a purge cycle.

Fuel vapor recovery systems create two general problems for feedback air/fuel ratio control. The induction of rich fuel vapors may exceed the range of authority of the feedback system. And, even when the air/fuel ratio feedback control system is capable of correcting for the induction of fuel vapors, the correction incurs a time delay before the perturbation in the inducted mixture propagates through the engine and exhaust to the exhaust gas oxygen sensor. During this time delay, perturbations in air/fuel ratio caused by induction of fuel vapors may go uncorrected.

The above problems have been addressed by U.S. Pat. No. 4,715,340 issued to Cook et al. More specifically, the rate of vapor flow is made proportional to airflow thereby reducing the perturbation in air/fuel ratio during a vapor purge. However, the inventor herein has recognized a disadvantage with this and similar approaches. More specifically, when throttle angle abruptly changes during a purge, a time delay is incurred before actual purge flow is increased in proportion to the increased inducted airflow. A lean perturbation in air/fuel ratio will occur during this time delay which is too rapid for correction by the air/fuel ratio feedback control system. Thus, every change in throttle angle may result in an uncorrected air/fuel ratio transient.

SUMMARY OF THE INVENTION

An object of the invention herein is to eliminate transient errors in air/fuel ratio which result from a change in the flow rate of fuel vapors inducted into the engine.

The above object and others are achieved, and disadvantages and problems of prior approaches overcome, by providing both a method and control system for controlling the induction of air, fuel, and fuel vapors. In one particular aspect of the invention, the control method comprises: air/fuel ratio control means for providing a desired fuel charge to the engine which is related to a measurement of airflow inducted into the engine thereby providing a desired air/fuel ratio; a fuel vapor recovery system for coupling fuel vapors from the fuel system into the engine, the fuel vapor recovery system including flow control means for controlling rate of flow of the fuel vapors in proportion to the desired fuel charge; and correction means for adding a correction factor to the desired fuel charge, the correction factor being related to the time delay of the fuel vapor flow through the fuel vapor recovery system for maintaining the desired air/fuel ratio.

In accordance with the above aspect of the invention, an advantage is obtained of minimizing any transient or perturbation in air/fuel ratio caused by changes in the rate of purge flow. More specifically, introducing the correction factor to the desired fuel charge, as claimed, reduces a transient in air/fuel ratio which would otherwise result from the delay in changing the rate of purge flow to maintain proportionality with a change in inducted airflow.

In accordance with another aspect of the invention, the control system comprises: measurement means for providing a measurement of mass airflow inducted into an air/fuel intake of the engine; an exhaust gas oxygen sensor coupled to an engine exhaust; air/fuel control means for providing a desired fuel charge signal related to the measurement of airflow, the air/fuel control means also being responsive to the exhaust gas oxygen sensor and a desired air/fuel ratio reference; a fuel system including at least one electronically actuated fuel injector coupled to a fuel tank through a fuel line and fuel pump, the fuel injector delivering fuel to the air/fuel intake in proportion to the desired fuel charge signals; a vapor recovery system including a vapor storage canister and purge line for coupling fuel vapors from both the fuel tank and the canister to the air/fuel intake via a solenoid; vapor flow means for regulating flow rate of the vapors into the air/fuel intake in proportion to the desired fuel charge signal by electronically modulating the solenoid valve with a modulation signal having a pulse width proportional to the desired fuel charge signal; and correction means for adding a correction factor to the desired fuel charge signal, the correction factor approximating the response time of a change in the vapor flow rate in relation to a change in the air flow measurement.

By correcting for the response time of the vapor recovery system, an advantage is obtained of avoiding air/fuel ratio perturbations which would otherwise occur with changes in inducted airflow.

BRIEF DESCRIPTION OF THE DRAWINGS

The object and advantages described above will be better understood by reading an example of an embodiment which utilizes the invention to advantage referred to with reference to the drawings wherein.

DESCRIPTION OF THE PREFERRED EMBODIMENT

Figure 1:
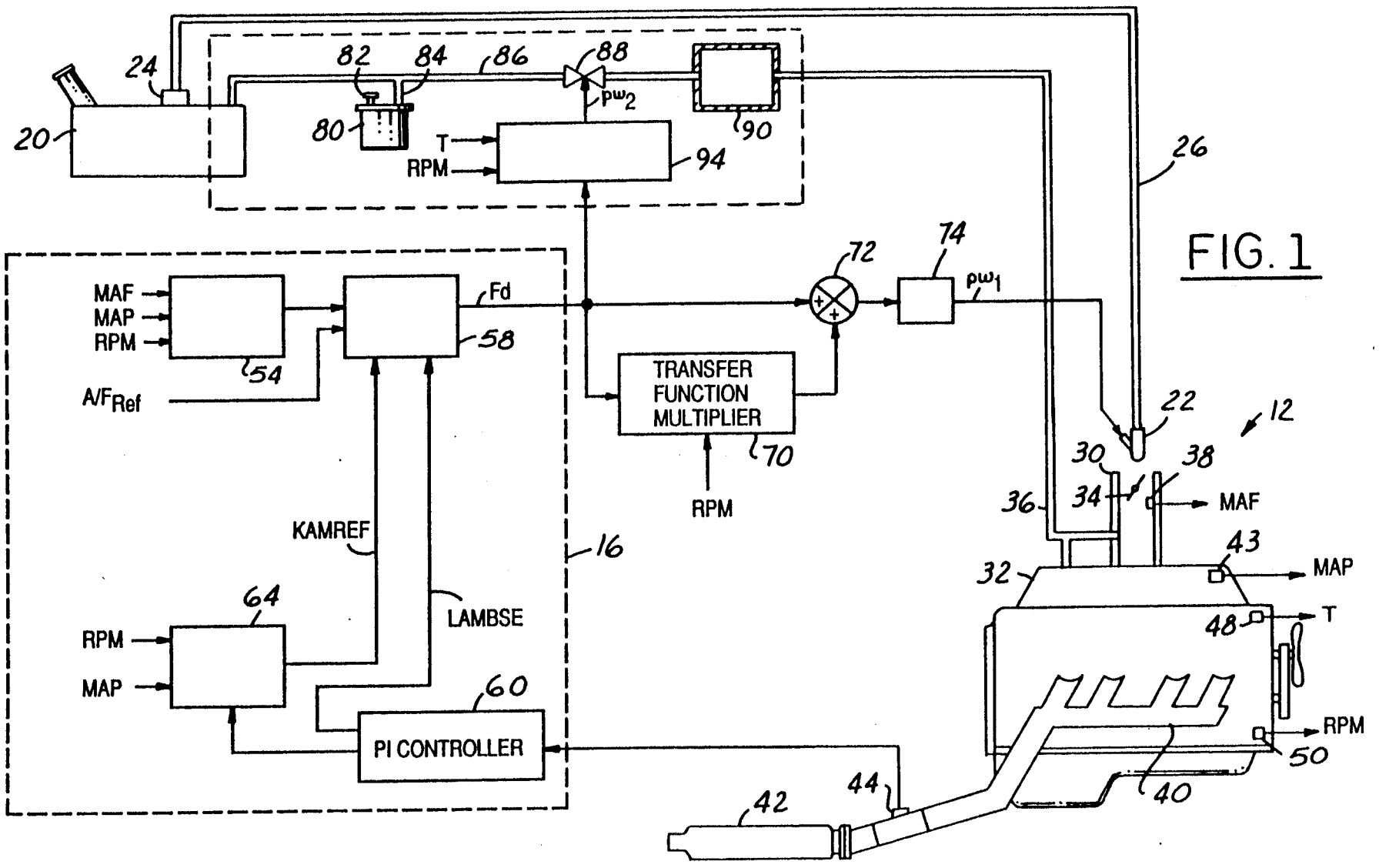
FIG. 1 is a block diagram of an embodiment in which the invention is used to advantage.

Referring first to FIG. 1 in general terms which are described in greater detail later herein, an example of a preferred embodiment which utilizes the invention to advantage is shown. Internal combustion engine 12 is shown coupled to fuel vapor control system 14 and air/fuel feedback control system 16. Fuel vapor control system 14 is shown coupled to a fuel system which includes conventional fuel tank 20 delivering fuel to electronically actuated fuel injector 22 via fuel pump 24 and fuel line 26. Engine 12 is shown having an air/fuel intake system including air/fuel inlet 30, with throttle plate 34 positioned therein, and intake manifold 32. Fuel injector 22 is shown coupled to air/fuel intake 30. Vapor purge line 36 is also shown coupled to air/fuel intake 30 although it may be coupled directly to intake manifold 32 as shown by the dashed lines in FIG. 1. Engine 12 also includes exhaust manifold 40 coupled to three-way ($NO_x$, CO, and HC) catalytic converter 42. Exhaust gas oxygen sensor (EGO) 44 is shown coupled to exhaust manifold 40. In this particular example, EGO sensor 44, and associated comparison and filtering circuitry (not shown), is a conventional two-state sensor. More specifically, EGO sensor 44 provides a high voltage level when actual air/fuel ratio is on the rich side of a desired air/fuel ratio, and provides a low voltage level when actual air/fuel ratio is on the lean side of the desired air/fuel ratio. A desired air/fuel ratio is selected at stoichiometry (14.7 lbs. air/1 lb. fuel) for optimizing the efficiency of catalytic converter 44.

Conventional sensors are shown coupled to engine 12 for providing indications of engine operating perameters used to advantage by the control systems described later herein. Mass airflow sensor 43 provides signal MAF which is related to the airflow inducted through air/fuel intake 30 into engine 12. Manifold pressure sensor 46 provides signal MAP related to the pressure in intake manifold 32. Temperature sensor 48 provides a measurement of the operating temperature of engine 12. Engine speed sensor 50, coupled to the crankshaft (not shown) of engine 12, provides signal RPM related to engine speed.

Air/fuel ratio control system 16 is now described in more detail with continuing reference to FIG. 1. Mass airflow calculator 54 provides a measurement of inducted mass airflow. In systems employing a mass airflow sensor, such as MAF sensor 43 shown herein, the mass airflow measurement is substantially provided by signal MAF. In other systems, mass airflow calculation is provided by a conventional speed density algorithm employing signal MAP and signal RPM.

Base fuel calculator 58 provides desired fuel charge signal Fd related to the desired air/fuel ratio (shown herein as signal $A/F_{ref}$). During open loop operation, signal Fd is derived by multiplying the measurement of inducted airflow by the inverse of $A/F_{ref}$. During closed loop operation, the product of $MAF \times (A/F_{ref})^{-1}$ is trimmed by feedback correction factors KAMREF and LAMBSE to generate desired fuel charge signal Fd as follows:

$$Fd = \frac{MAF \times KAMREF}{14.7 \times LAMBSE}$$

In this expression, $A/F_{ref}$ has been chosen to be 14.7.

Feedback correction factor LAMBSE is provided by conventional proportional integral (PI) controller 60 which is responsive to EGO sensor 44. That is, the rich/lean signal from EGO sensor 44 is multiplied by a gain constant and integrated to provide signal LAMBSE. Thus, the actual fuel delivered is trimmed by operation of air/fuel ratio feedback controller 16 such that air/fuel operation of engine 12 is maintained near $A/F_{ref}$.

Long term feedback correction is also provided by feedback correction signal KAMREF from adaptive table 64. The purpose of signal KAMREF is to provide an air/fuel offset under speed/load conditions wherein excessive air/fuel corrections have been made. For example, excessive wear of fuel injector 22 may result in a richer than desired air/fuel mixture and, accordingly, continuous lean corrections by signal LAMBSE. To reduce continuous corrections, the rich/lean signal is integrated for a substantially longer time than signal LAMBSE, and the correction factor stored as signals KAMREF in adaptive table 64. Separate KAMREF signals are generated for a plurality of engine load and speed regions over which the rich/lean signal is integrated.

As described in greater detail hereinafter, transfer function multiplier 70 multiplies signal Fd with a transfer function related to the response time of vapor recovery system 14. This product is then added to signal Fd in summer 72 to generate a corrected or compensated desired fuel charge. In response, conventional fuel module 74 generates signal $pw_1$ having a pulse width proportional to compensated signal Fd for actuating fuel injector 22.

Fuel vapor recovery system 14 is shown including vapor canister 80, a canister containing activated charcoal in this example, having atmospheric vent 82. Canister 80 is shown having an inlet 84 for recovering fuel vapors from tank 20. Inlet 20 is also shown coupled to an inlet side of solenoid valve 88 via purge line 86. As described in greater detail later herein, the rate of purge flow through solenoid valve 88 is controlled by the pulse width or duty cycle of actuating signal $pw_2$ from purge controller 94. When solenoid valve 88 is closed, fuel vapors flow from tank 20 through canister 80 and out through vent 82. When solenoid valve 88 is open, ambient air flows in vent 82 through canister 80, thereby absorbing stored hydrocarbons, and out inlet 84 into purge line 86. Concurrently, fuel vapors are inducted directly from tank 20 through purge line 86.

The outlet side of solenoid valve 88 is shown coupled to air/fuel intake 30 of engine 12 via purge line 36. In this particular example, reservoir 90 is also shown coupled to purge line 36 for averaging out fluctuations in vapor purge flow caused by modulation of solenoid valve 88. Stated another way, reservoir 90 acts as a capacitor forming the time derivative of modulated flow from solenoid valve 88.

Figure 2A:
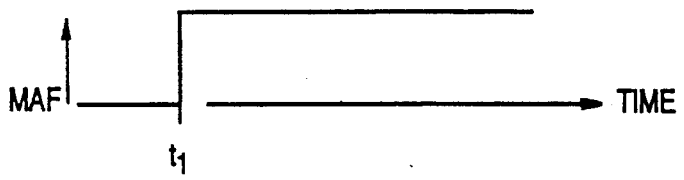
FIGS. 2A–2F show a graphical illustration of operation of a portion of the embodiment shown in FIG. 1.
Figure 2B:
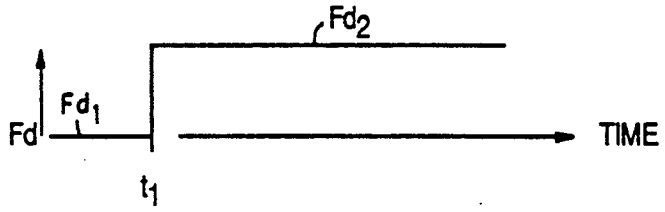
Figure 2C:
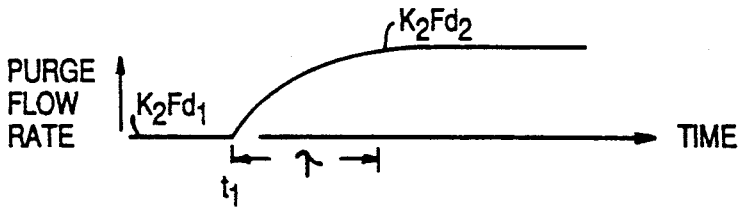

Purge controller 94 actuates a vapor purge in response to engine operating conditions such as when temperature and engine speed are above threshold values. During a vapor purge, the rate of purge flow is made proportional to signal Fd and, accordingly, the measurement of inducted mass airflow. Stated another way, signal $pw_2$ is made proportional to signal Fd such that the amount of fuel vapors purged from fuel tank 20 and canister 80 may be expressed by $k \times Fd$. As previously discussed herein, the rate of purge flow is made proportional to inducted airflow for reducing air/fuel transients and preventing operation of air/fuel control system 16 beyond its range of authority. A disadvantage or problem of the system so far described, however, is that there is an inherent time delay in changing purge flow as airflow changes. This time delay is due to solenoid valve 88, purge controller 94, purge line 36, and, if used, reservoir 90. An illustration of the problem is shown in FIGS. 2A–2F. Assuming a rapid throttle increase at time $t_1$, and resulting increase in Fd (or MAF) as shown in FIGS. 2A–2B, the change in purge flow lags by a time response during transient time $\tau$ as shown in FIG. 2C. Without correction or compensation, the air/fuel ratio will have a transient perturbation as shown by the dashed line in FIG. 2E. This air/fuel transient is avoided as follows:

Assuming the total desired fuel charge is equal to Fd plus a proportional amount of fuel vapors $k \times Fd$, and assuming a first order time response of purge control system 14, the actual fuel delivered is represented by:

$$\text{Actual Fuel Delivered} = Fd + k \times Fd/(\tau S + 1)$$

where:

$\tau$ = time constant

S = LaPlace operator

A fuel correction transfer function, or compensation value, of $Fd \times k \times \tau S/(\tau S + 1)$ from transfer function multiplier 70 (FIG. 1) is added to Fd by summer 72 (FIG. 1) such that:

$$\text{Actual Fuel Delivered} = Fd + k \times Fd/(\tau S + 1) + k \times Fd \times \tau S/(\tau S + 1)$$

Thus, by adding the fuel correction transfer function, the actual fuel delivered is the desired value ($Fd + k \times Fd$). It is noted that the transfer function is related to engine speed, such that the correction factor or transfer function is operative only during changes in engine operation.

Figure 2D:
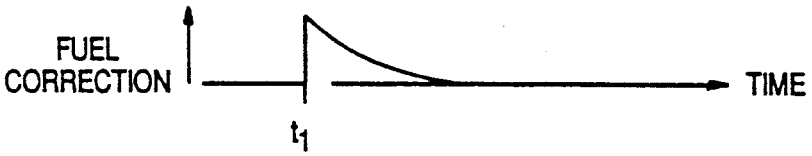
Figure 2E:
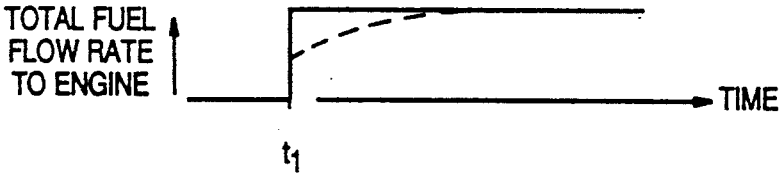
Figure 2F:
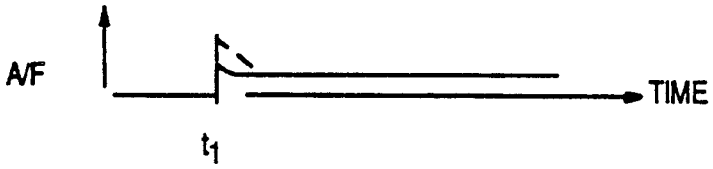

The effect of the fuel correction transfer function is graphically shown in FIGS. 2D–2F. At time $t_1$, the fuel correction $k \times Fd \times \tau S/(\tau S + 1)$ is added such that the total fuel delivered is $Fd + k \times Fd$ as shown by the solid line in FIG. 2E (note, the dashed line of FIG. 2E represents total fuel delivered without correction). Referring to the solid line of FIG. 2F, it is seen that the air/fuel ratio transient which would otherwise occur without correction (dashed line) is drastically reduced (solid line).

This concludes the Description of the Preferred Embodiment. The reading of it by those skilled in the art will bring to mind many alterations and modifications without departing from the spirit and scope of the invention. For example, the invention may be used to advantage with either fuel injected or carbureted engines. Further, the transfer function may approximate time delay other than a first order approximation. Accordingly, it is intended that the scope of the invention be limited only by the following claims.

What is claimed:

1. A control system for an internal combustion engine, comprising:

measurement means for providing a measurement of mass airflow inducted into an air/fuel intake of the engine;

an exhaust gas oxygen sensor coupled to an engine exhaust;

air/fuel control means for providing a desired fuel charge signal related to said measurement of airflow, said air/fuel control means also being responsive to said exhaust gas oxygen sensor and a desired air/fuel ratio reference;

a fuel system including at least one electronically actuated fuel injector coupled to a fuel tank through a fuel line and fuel pump, said fuel injector delivering fuel to said air/fuel intake in proportion to said desired fuel charge signals;

a vapor recovery system including a vapor storage canister and purge line for coupling fuel vapors from both said fuel tank and said canister to said air/fuel intake via a solenoid;

vapor flow means for regulating flow rate of said vapors into said air/fuel intake in proportion to said desired fuel charge signal by electronically modulating said solenoid valve with a modulation signal having a pulse width proportional to said desired fuel charge signal; and correction means for adding a correction factor to said desired fuel charge signal, said correction factor approximating response time of a change in said vapor flow rate in relation to a change in said air flow measurement.

2. The control system recited in claim 1 wherein said correction factor approximates a first order time response.

3. A control system for controlling induction of a mixture of air, fuel and fuel vapors into an internal combustion engine, comprising:

delivery means for delivering the liquid fuel into the engine in proportion to a measurement of rate of airflow inducted into the engine;

purge control means including an electrically controlled valve coupled between a reservoir and the engine for altering rate of fuel vapor flow into the engine by electrically controlling said valve in proportion to said measurement of inducted airflow; and open loop correction means for adding a correction factor to the liquid fuel delivered by said delivery means concurrently with said alteration in rate of fuel vapor flow, said correction factor approximating transient response time of said valve during said alteration in rate of fuel vapor flow during said transient response time.

4. The control system recited in claim 3 wherein said open loop correction means further comprises means for multiplying a value representative of the liquid fuel delivered to the engine by a first order transfer function representing said transient response time of said valve.

5. The control system recited in claim 3 wherein said reservoir further comprises a vapor storage canister coupled to a fuel tank.

6. A control system for controlling induction of a mixture of air, fuel and fuel vapors into an internal combustion engine, comprising:

feedback control means for delivering the liquid fuel into the engine in response to rate of airflow inducted into the engine and an exhaust gas oxygen sensor coupled to the engine exhaust to maintain a desired air/fuel ratio of the inducted mixture;

purge control means including an electrically controlled valve coupled between a reservoir and the engine for altering rate of fuel vapor flow into the engine by electrically controlling said valve; and open loop correction means for adding a correction factor to the liquid fuel delivered by said feedback control means concurrently with said alteration in rate of fuel vapor flow, said correction factor approximating transient response time of said valve during said alteration in rate of fuel vapor flow during said transient response time thereby maintaining said desired air/fuel ratio during said transient response time of said valve.

7. The control system recited in claim 6 wherein said purge control means maintains said rate of fuel vapor flow linearly proportional to said rate of airflow.

8. The control system recited in claim 6 wherein said purge control means shuts off said fuel vapor flow in response to engine operating parameters.

9. A control system for controlling induction of a mixture of air, fuel and fuel vapors into the air/fuel intake of an internal combustion engine, comprising:

feedback control means for delivering the liquid fuel into the engine air/fuel intake in response to rate of airflow inducted into the engine and an exhaust gas oxygen sensor coupled to the engine exhaust to maintain a desired air/fuel ratio of the inducted mixture;

a fuel vapor recovery system comprising an electrically controlled valve coupled between a source of the fuel vapors and the engine air/fuel intake;

purge control means for altering rate of fuel vapor flow into the engine by electrically controlling said valve; and open loop correction means for adding a correction factor to the liquid fuel delivered by said feedback control means concurrently with said alteration in rate of fuel vapor flow, said correction factor approximating transient response time of said valve during said alteration in rate of fuel vapor flow during said transient response time.

10. The control system recited in claim 9 wherein said source of fuel vapors of said fuel vapor recovery system further comprises a vapor storage canister coupled in parallel with a fuel storage tank.

11. The control system recited in claim 9 wherein said purge control means maintains said rate of fuel vapor flow linearly proportional to said rate of airflow.

12. The control system recited in claim 9 wherein said purge control means shuts off said fuel vapor flow in response to an engine operating parameter.

* * * * *